US005809704A

United States Patent [19]

Stewart et al.

[11] Patent Number: 5,809,704

[45] Date of Patent: Sep. 22, 1998

[54] HILLSIDE MULTISTORY RESIDENTIAL DWELLING STRUCTURE

[76] Inventors: Jerry W. Stewart; W. Bryan Thruston, both of 8144 Walnut Hill La., Suite 460, Dallas, Tex. 75231

[21] Appl. No.: 713,678

[22] Filed: Sep. 17, 1996

[51] Int. Cl.[6] ..... E02D 27/00; E04H 1/04

[52] U.S. Cl. ..... 52/169.4; 52/79.1; 52/185; 52/236.3

[58] Field of Search ..... 52/169.3, 169.4, 52/169.9, 175, 185, 236.3, 236.4, 236.5, 79.1, 79.2

[56] References Cited

U.S. PATENT DOCUMENTS

| | | | |
|---|---|---|---|
| 1,654,684 | 1/1928 | Earle | 52/236.3 X |
| 3,656,266 | 4/1972 | Tylius | 52/30 |
| 3,724,143 | 4/1973 | Paukulis | 52/79 |
| 3,750,354 | 8/1973 | Boros | 52/236 |
| 3,755,974 | 9/1973 | Berman | 52/185 X |
| 3,884,001 | 5/1975 | Tylius | 52/185 |
| 4,041,661 | 8/1977 | Hurwitz | 52/169.4 |
| 4,345,407 | 8/1982 | Fishman | 52/169.3 |
| 4,593,097 | 6/1986 | Stewart et al. | 52/185 |
| 4,602,464 | 7/1986 | Medel | 52/263.4 |

OTHER PUBLICATIONS

Article "The New Row House" From Magazine Progesive Architecture, p. 124, Aug. 1964.

Article "Cluster Houses" From Magazine Better Homes and Gardens, p. 64, 1971.

*Primary Examiner*—Winnie S. Yip

*Attorney, Agent, or Firm*—Akin, Gump, Strauss, Hauer & Feld, L.L.P.

[57] ABSTRACT

A hillside, multistory, multiple dwelling unit building includes at least two vertically stacked dwelling units wherein the lower dwelling unit has a ground level garage or vehicle parking space with an entry opening in one direction and the other dwelling unit has a garage or parking space vertically stacked above the first garage and opening to roadway on a hill adjacent to which the building is situated. The first dwelling unit may have two living space levels above the garage level, the second level being at the same level as and sharing some interior space withe the garage of the upper dwelling unit. The upper dwelling unit has two living space levels above its garage level. The building structure may be formed of reinforced concrete sidewalls and floors defining each level and formed as elongated "tunnels". The dwelling unit endwalls may be non-load bearing and have windows and balconies opening to the side of the vertically stacked dwelling units are provided. The first through the third levels may have a reinforced endwall contiguous with the earthen hill to avoid the requirement of seperate retaining walls.

33 Claims, 13 Drawing Sheets

HILLSIDE MULTISTORY RESIDENTIAL DWELLING STRUCTURE

FIELD OF THE INVENTION

The present invention pertains to hillside multistory multiunit residential dwelling structures including vertically stacked vehicle garage or parking areas which are accessible from roadways at different elevations and from opposite directions.

BACKGROUND

The continuing need to develop available land in densely populated urban areas and the like has required giving consideration to building multiple dwelling unit apartment or condominium type structures in areas where the terrain is substantially uneven or hilly. The needs and desiderata with respect to multiple dwelling unit multistory structures has also pressed the requirement that each dwelling unit have a garage, carport or otherwise substantially private vehicle parking area, have private access between the garage, carport or parking area and the associated dwelling unit and also, of course, provide the resident of each dwelling unit with a desirable exterior view. Structures built on hillside sites, in particular, require or desirably should have one or more rooms which provide an aesthetically pleasing view from the hillside itself.

The construction of hillside structures also presents certain other problems. For example, in order to prevent erosion or sloughing of freshly graded soil, required for construction and terrain altering purposes, sufficient retaining wall structures are required. Such structures are often prohibitively expensive, particularly when constructing large multiunit residential dwelling complexes.

Accordingly, there have been several needs and problems associated with the development of hillside, multistory, multiple dwelling unit structures which heretofore have been substantially unfulfilled and unsolved. It is to these ends that the present invention has been developed.

SUMMARY OF THE INVENTION

The present invention provides a hillside multistory structure, particularly adapted for one or more residential dwelling units. More particularly, the present invention provides a hillside, multistory, multiple dwelling unit structure adapted for high density housing in urban hillside areas and areas in which multiple dwelling unit structures are provided to take advantage of a particularly aesthetically pleasing setting or view.

In accordance with one aspect of the present invention a multistory, multiple dwelling unit structure is provided for a hillside setting wherein multiple dwelling units are arranged vertically stacked and have vehicle parking spaces, such as garages or carports, for each dwelling unit which may also be vertically stacked and accessible from opposite directions and from spaced apart elevations. In particular, a unique arrangement of multiple, multilevel individual dwelling units is provided wherein each dwelling unit has a vehicle garage or parking space associated with the dwelling unit, a private entrance between the garage or parking space and the dwelling unit and each dwelling unit is provided with a floor plan which is convenient for residential purposes and which provides an exterior view from the hillside from one or more rooms.

In accordance with another aspect of the present invention a hillside, multistory, multiple dwelling unit structure is provided which is built into the hillside in a manner wherein at least certain exterior walls of one or more dwelling units also function as a hillside retaining wall. The multistory hillside structure may be advantageously constructed of reinforced concrete, concrete block or other masonry construction. In one preferred embodiment the multiple vertically stacked levels of the structure are constructed as elongated poured concrete "tunnels" wherein at least the structure sidewalls, floors and ceilings are formed of poured reinforced concrete. In another preferred embodiment at least those levels of the dwelling units which require such have transverse endwalls formed of poured concrete integral with the longitudinal sidewalls and floors or ceilings and are contiguous with the terrain of the hillside to function as retaining walls.

The hillside multistory structures of the present invention provide several advantages. High density multistory multiple unit housing is easily provided in areas which have modest or steep hills or other uneven terrain. Vehicle parking spaces for vertically stacked dwelling units are provided for each unit with access from opposite directions at different elevations corresponding to at least one level of a unit or units, and with private entries associated with each vehicle garage or parking area. The multistory, multiple dwelling unit structures may be advantageously constructed of reinforced concrete longitudinal sidewalls, ceilings and floors and at least certain transverse endwalls, if desired. Alternatively, the structures may be constructed of other materials, such as concrete block or brick.

Those skilled in the art will further appreciate the above mentioned advantages and superior features of the invention together with other important aspects thereof upon reading the detailed description which follows in conjunction with the drawing.

DESCRIPTION OF THE PREFERRED EMBODIMENTS

Figure 1:
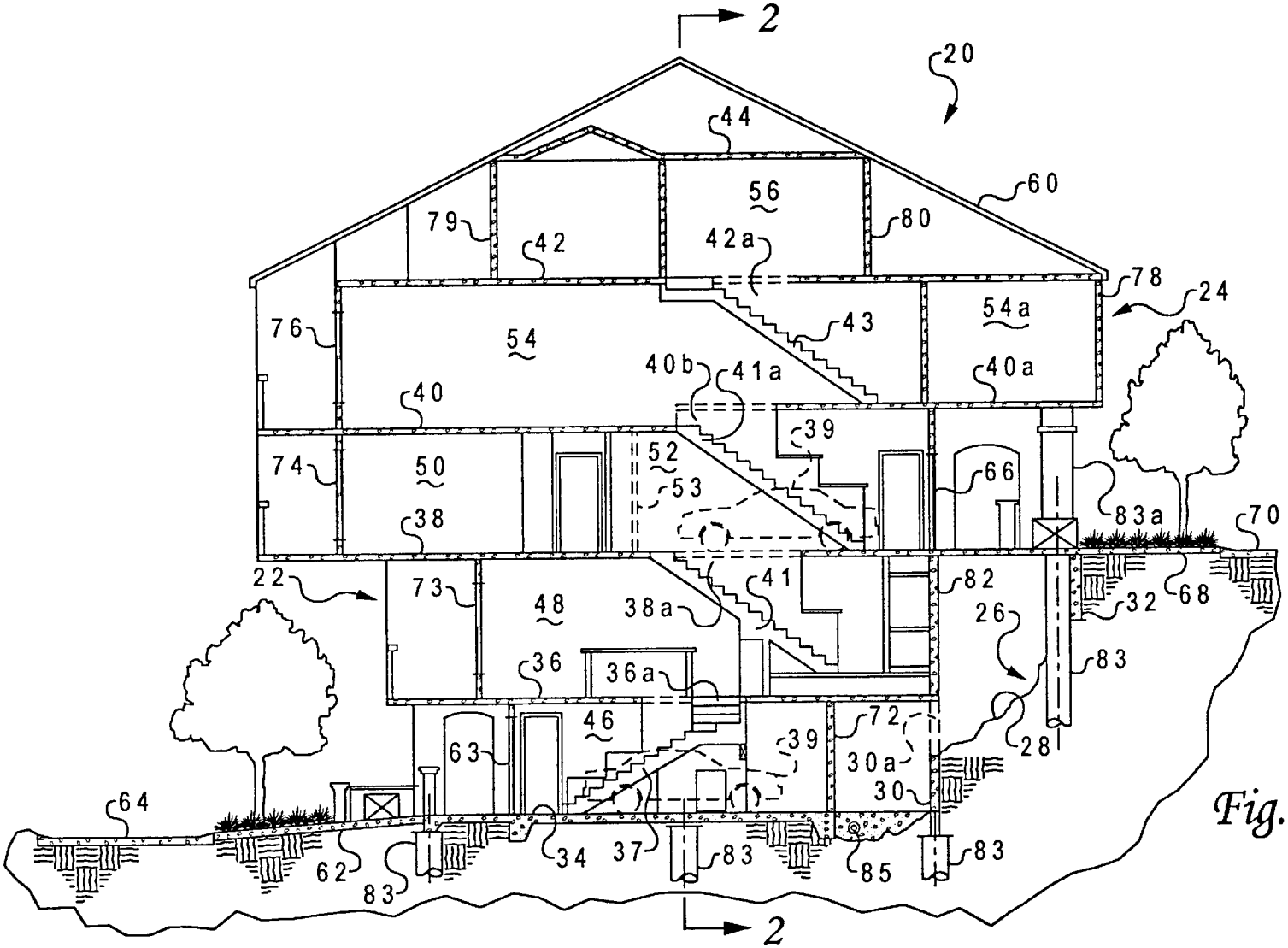
FIG. 1 is a longitudinal vertical section view of a hillside, multistory, multiple dwelling unit structure in accordance with the invention.

In the description which follows like elements are marked throughout the specification and drawing with the same reference numerals, respectively. Certain elements in the drawings may not be shown to scale in the interest of clarity and conciseness.

Figure 2:
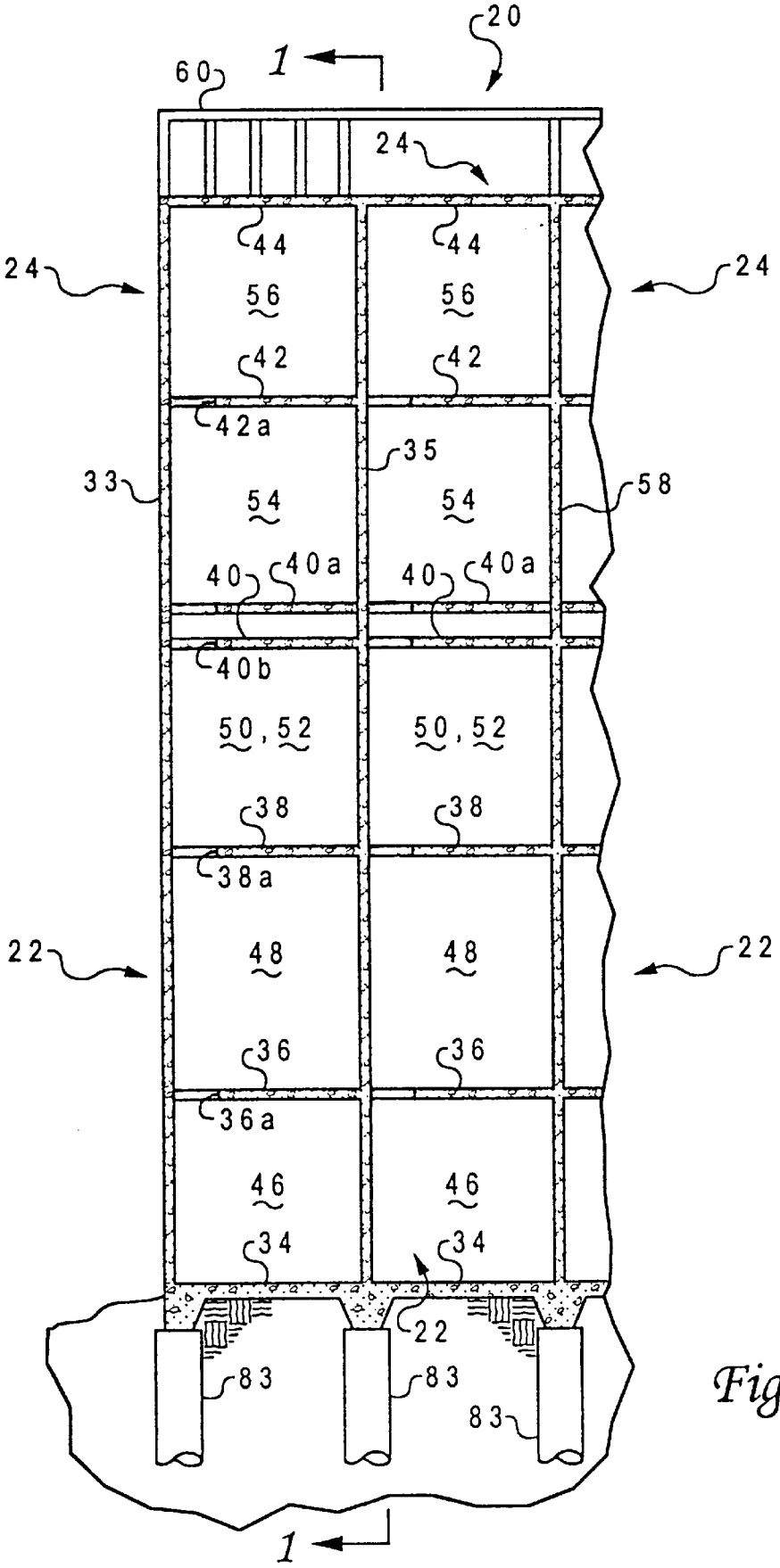
FIG. 2 is a section view taken generally along the line 2—2 of FIG. 1.

Referring to FIG. 1, there is illustrated a hillside, multistory, multiple dwelling unit structure in accordance with the invention and generally designated by the numeral 20. The structure 20 is characterized as a multistory apartment or condominium style structure or building having at least two vertically stacked dwelling units and multiple dwelling units side by side. A first or lower dwelling unit is generally indicated at 22 and an upper level or second dwelling unit is generally indicated at 24 in FIG. 1. As shown in FIG. 2 multiple lower dwelling units 22 and multiple upper dwelling units 24 may be constructed side by side and share common walls therebetween. The building 20 is shown constructed adjacent to uneven earthen terrain or a hill 26. In particular, the hill 26 has been altered to provide a desired sloped earthen wall 28 and spaced apart vertically extending concrete retaining walls 30 and 32 are provided for stabilizing the hill 26 against unwanted erosion, sloughing or collapse.

The building 20 further includes a first level floor 34 of reinforced concrete and comprising at least part of the foundation of the building 20. A second level floor 36 is disposed above the floor 34 suitably spaced therefrom in accordance with architectural requirements. A third level floor 38 is vertically spaced above the second level floor 36. A fourth level floor 40, including a split level portion 40*a* and forming part of the dwelling unit 24, is spaced above the floor 38. A fifth level floor 42 is suitably vertically spaced from, floor 40, 40*a* and suitably spaced below a ceiling portion 44. A stairway opening 36*a* is provided in floor 36, FIGS. 1 and 2, for a stairway 37 between floor 34 and floor 36. A stairway opening 38*a* is provided in floor 38 for a stairway 41 between floors 36 and 38. Still further, a stairway opening 40*b* is provided between floors 38 and 40, 40*a* for a stairway 41*a* and, finally, a stairway opening 42*a* is provided between floors, 40*a* and 42 for a stairway 43. As indicated in FIG. 2, the stairway openings 36*a*, 38*a*, 40*b* and 42*a* are aligned with each other adjacent one vertical sidewall 33 of building 20. An adjacent sidewall 35 is spaced from sidewall 33 to define the interior spaces of each dwelling unit 22 and 24.

For example, viewing FIG. 2, vertical sidewalls 33 and 35 and floors 34 and 36 define a vehicle garage or parking space 46 operable for parking one or more conventional automotive vehicles 39, one shown in FIG. 1. Vertical sidewalls 33 and 35 together with floors 36 and 38 define a living space 48 stacked above space 46. Walls 33 and 35 together with floors 38, 40 and 40*a* define additional living space 50, FIG. 1, for dwelling unit 22 and also define a vehicle garage or parking space 52 for dwelling unit 24 also operable for parking another automotive vehicle 39. Sidewalls 33 and 35, together with floors 40, 40*a* and 42, define a living space 54, 54*a* for dwelling unit 24. The sidewalls 33 and 35, together with floors 42 and ceiling 44, define further living space 56 for dwelling unit 24. Floor plans for dwelling units 22 and 24 will be described in further detail herein. The living spaces for dwelling units 22 and 24 are repeated for each set of vertically stacked dwelling units and, for example, viewing FIG. 2, vertical sidewall 35 and vertical sidewall 58 also define a set of two vertically stacked dwelling units 22 and 24 and the associated living spaces therefor.

One advantageous method of constructing the building 20 is forming the floors 34, 36, 38, 40, 40*a*, 42, the ceiling 44 and the sidewalls 33, 35, 58, and so on, as a poured concrete structure wherein the levels of dwelling unit 22 and the levels of dwelling unit 24 are constructed somewhat as concrete rectangular box-like tunnels, using methods known to those of skill in the art. Alternatively, the aforementioned floors and sidewalls may be constructed of other materials. The sidewalls 33, 35 and 58 may, for example, be concrete block or other masonry structures and the floors extending therebetween and vertically spaced from each other may be built up of suitable beams and decking. However, the reinforced poured concrete construction described above is advantageous. The building 20 includes a conventional truss-type pitched roof 60, as shown in FIGS. 1 and 2.

Referring further to FIG. 1, access to the vehicle garage or parking space 46 is obtained by a driveway 62 extending between a vehicle entry opening 63 and a roadway or street 64. The entry 63 opens to one side of the building 20 and the garage or vehicle parking space 52 has an entry 66, FIG. 1, which opens to the opposite side of the building 20 and is aligned with a concrete driveway 68 extending between garage or parking space 52 and a street or roadway 70. Accordingly, the building 20 takes advantage of the hill 26, upon construction of roadways or streets 64 and 70, by providing vertically stacked dwelling units and vertically stacked vehicle garages or parking areas or spaces, such as the garages 46 and 52 which may be accessed from opposite sides of the building. The building 20 also provides separate entries between the garages and the respective dwelling units 22 and 24 by way of stairways 37 and 41, respectively. Accordingly, the building 20 takes advantage of certain features described in U.S. Pat. No. 4,596,097 issued Jun. 24, 1986 to Stewart et al. However, the building 20 also advantageously utilizes the hill 26 to provide for vertically stacking the garages or parking spaces 46 and 52.

The exterior endwalls and interior endwalls of the dwelling units 22 and 24 may be constructed of non-load bearing materials. Such endwalls are indicated by numeral 72 between floors 34 and 36. Endwalls 73 and 82 are provided at the ends of living space 48. A garage door, not shown, may be provided at entry 63. Endwalls 74 and 53 enclose space 50, and a suitable garage door may be provided at the opening 66, not shown, between floors 38 and 40. Endwalls 76 and 78 are provided for dwelling unit 24 to enclose living spaces 54 and 54*a* and endwalls 79 and 80 are provided between floor 42 and ceiling 44. A load bearing shear wall 82, FIG. 1, may be provided between floors 36 and 38 and formed of reinforced concrete at the same time that the aforementioned poured concrete walls of the building 20 are created. Endwall 82 may be an extension of retaining wall 30, also, and having suitable openings 30*a* formed therein, FIG. 1. Accordingly, wall 82 becomes a load bearing member for driveway 68 at one end thereof, as shown in FIG. 1. Suitable support piers 83 are provided under the poured concrete members forming floor 34, under driveway 68 and extending by way of a pier 83*a* to floor 40*a*, as shown in FIGS. 1 and 2. Piers 83 are provided, as needed, depending on soil strength and stability on which the structure 20 is constructed. Suitable drainage from the area between the lower dwelling unit 22 and the retaining wall 30 may be obtained by buried drain pipe 85, FIG. 1, extending along the edge of floor 34 adjacent the endwall 72.

Figure 3:
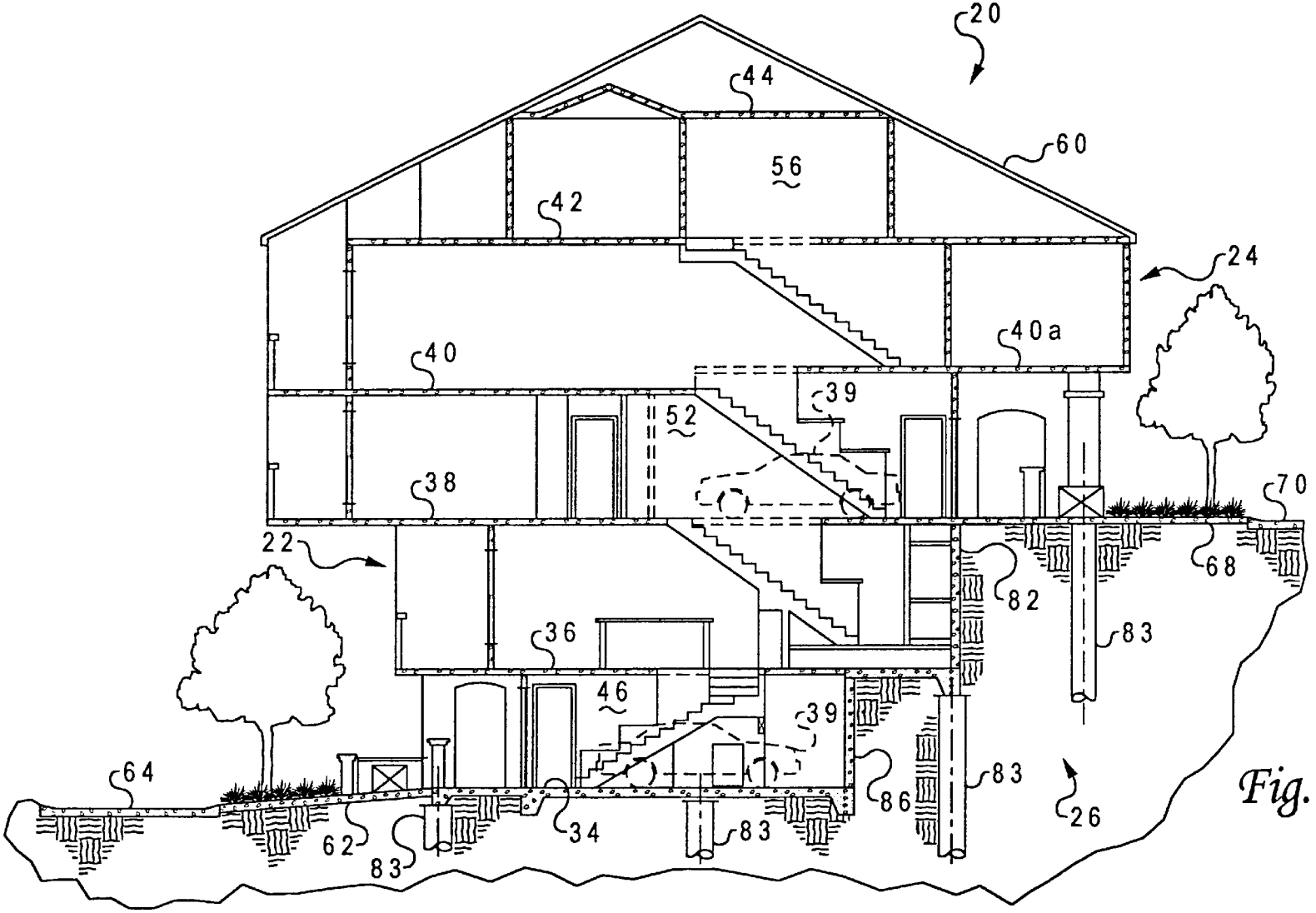
FIG. 3 is a section view similar to FIG. 1 showing a modified structure built into a hill.

The dwelling structure or building 20 may also be built into the hill 26 in a way such that the endwall 82 and a similar concrete endwall 86 for the interior garage space 46 form earth retaining walls, as shown in FIG. 3. The arrangement of the structure 20 shown in FIG. 3 is substantially the same as that of FIGS. 1 and 2 except that the endwalls of dwelling unit 22 which face the hill 26 are windowless, and are formed of concrete block, poured concrete or other masonry material of sufficient strength to form a retaining wall for the earth of hill 26. In this way the exterior walls 82 and 86 of the structure 20 also serve as retaining walls for the hill 26. Piers 83 are positioned below floors 34 and 36, as required by soil strength and stability conditions.

FIGS. 4 through 8 show one preferred floor plan arrangement for the dwelling units 22 and 24. For example, referring to FIG. 4, the lower level of dwelling unit 22 is shown in plan view wherein the vehicle garage or parking space 46 is shown with an additional inverted L-shaped interior space 46*a* provide between walls 33 and 35 and adjacent endwalls 72 or 86. Stairway 37 extends from exterior entry 63*b* or garage entry 63*c* along and adjacent to sidewall 33 and leads to the interior space 48 shown in FIG. 5 which may include a kitchen area 48*a* and bathroom 48*b* as well as a living area 48*c*.

Figure 5:
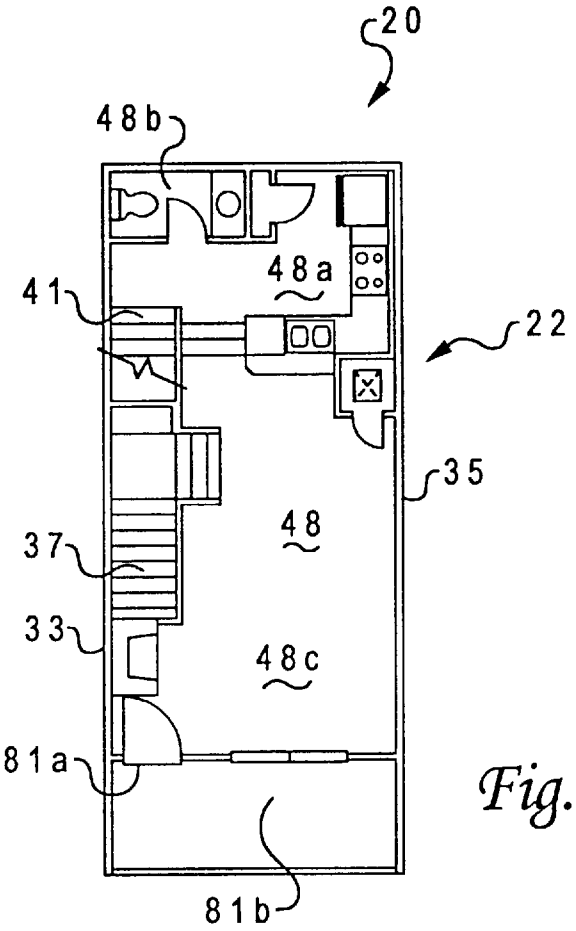
FIG. 5 is a plan view of the first living level of the structure shown in FIGS. 1 through 3.
Figure 4:
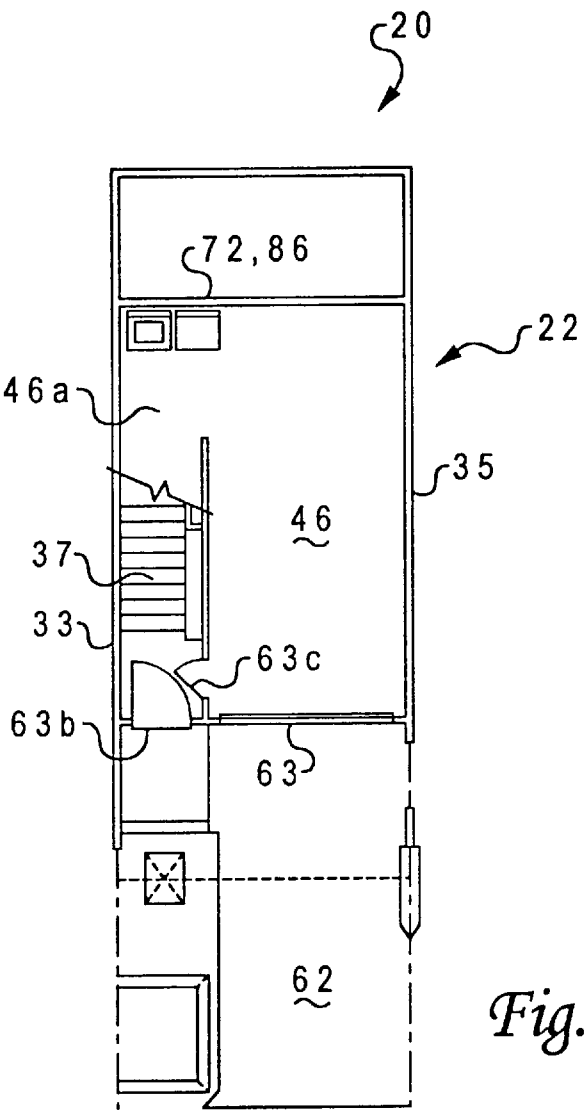
FIG. 4 is a plan view of the garage level of the lower dwelling unit of the structure shown in FIGS. 1 through 3.
Figures 6, 7, 8:
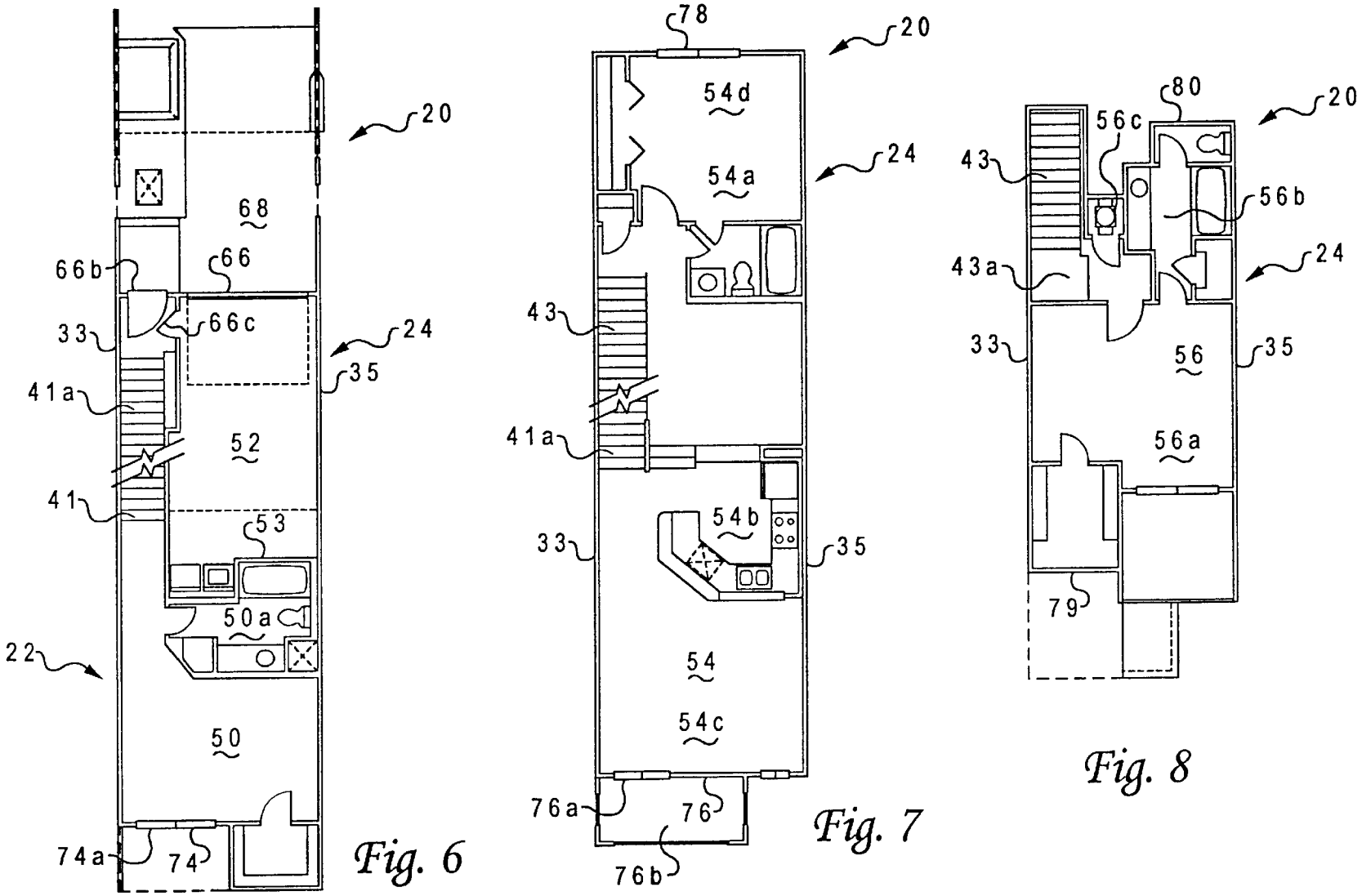
FIG. 6 is a plan view of the second living level of the lower dwelling unit and the garage level of the second or upper dwelling unit of the structure shown in FIGS. 1 through 3.
FIG. 7 is a plan view of the first living level of the upper dwelling unit of the structure shown in FIGS. 1 through 3.
FIG. 8 is a plan view of the second living level of the upper dwelling unit of the structure shown in FIGS. 1 through 3.

A third level of dwelling unit 22 is shown in the floor plan of FIG. 6 including living area 50 which may comprise a bedroom and bathroom, the latter designated by numeral 50*a*. Living area 50, 50*a* is accessed by stairway 41 which is aligned with and is disposed directly over stairway 37, as shown in FIGS. 1, 5 and 6. FIG. 6 also illustrates that the floor 38 representing the third level of the building 20 also includes the garage or vehicle parking space 52 and the entry stairway 41*a* for dwelling unit 24. Accordingly, as shown in FIG. 6, the building 20 advantageously utilizes floor 38 as both a living area for dwelling unit 22 and a vehicle parking area for dwelling unit 24.

Referring to FIG. 7, dwelling unit 24 also, advantageously, includes a living area occupying interior living space 54, including a kitchen 54*b* and adjacent living area 54*c* between sidewalls 33 and 35 and endwall 76. Interior space 54*a* may be divided into two living areas including a bedroom 54*d*, as shown. FIG. 7 also illustrates that stairways 41*a* and 43 are aligned and substantially overlie each other, as shown. Stairway 41*a* interconnects exterior entry 66*b* and garage entry 66*c* with living space 54. Stairway 43, of course, leads to interior space 56 on floor 42, see FIG. 8. Interior space 56 may comprise a bedroom 56*a* and adjacent bathrooms 56*b* and 56*c*, the latter being directly accessible from a landing 43*a* of stairway 43.

Although the floor plan illustrated in FIGS. 4 through 8 for the dwelling units 22 and 24 is advantageous, those skilled in the art will recognize that other floor plans for the dwelling units 22 and 24 may be provided. Moreover, the vehicle parking spaces 46 and 52 may be adapted for parking more than one vehicle in tandem or side by side, depending on the dimensions of the dwelling units. However, the vertical stacking of the garages or parking spaces 46 and 52 and the arrangement of vertically stacked living areas or interior spaces 48 and 50 for the dwelling unit 22, and spaces 54, 54*a* and 56 for the dwelling unit 24, advantageously utilizes available space in a hillside dwelling unit structure while providing substantial privacy for the occupants of the respective dwelling units. Separate opposed entrances 63*b*, 63*c* and 66*b*, 66*c* are provided to each of the dwelling units 22 and 24 and vehicle entries, which are accessed from opposite directions, are separated by at least one and preferably two levels so that suitable available space is provided at an intermediate level for a main living area of one of the dwelling units. Still further, each of the dwelling units 22 and 24 is provided with a view looking away from the hill 26. For example, endwall 73 of living area 48*c* may comprise suitable panoramic windows and/or sliding glass doors 73*a*, FIG. 5, opening to a balcony 73*b*. As shown in FIG. 6, second level living area occupying interior space 50 may include suitable panoramic windows 74*a* in endwall 74, for example. Still further, viewing FIG. 7, endwall 76 may have suitable panoramic windows and/or glass doors 76*a* opening onto a balcony 76*b*.

Figure 9:
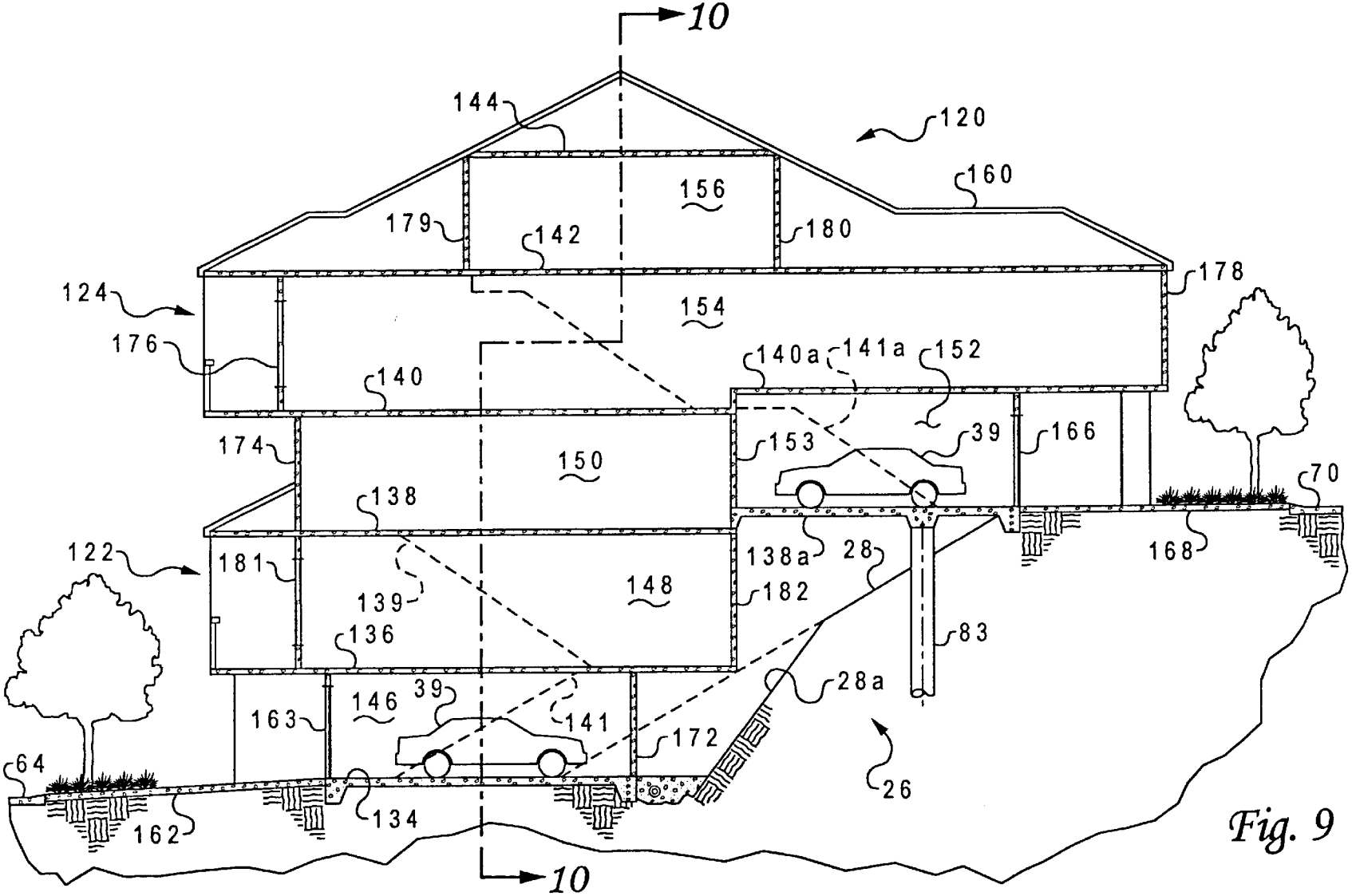
FIG. 9 is a vertical longitudinal section view similar to FIG. 1 showing a first alternate embodiment of a hillside, multistory, multiple dwelling unit structure in accordance with the invention.
Figure 10:
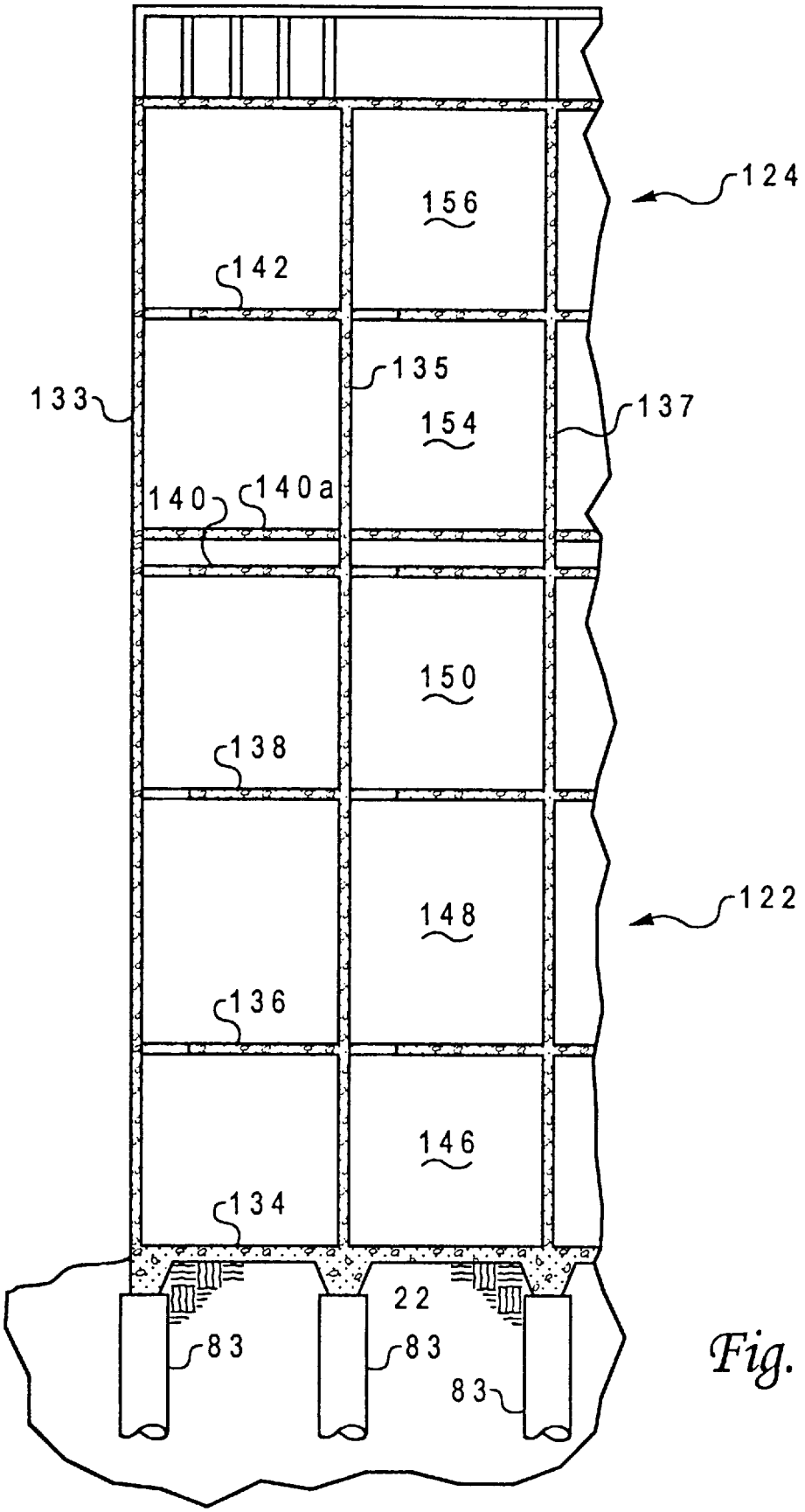
FIG. 10 is a section view taken generally along the line 10—10 of FIG. 9.

Referring now to FIGS. 9 and 10, an alternate embodiment of a hillside, multistory, multiple dwelling unit structure is illustrated and generally designated by the numeral 120. The structure 120 includes a first level or floor 134 comprising a poured concrete slab, for example, connected to a driveway 162 and a paved street or roadway 64. The structure 120 is constructed essentially the same as the structure or building 20 in that vertical sidewalls 133, 135, 137 and so on, are erected, see FIG. 10, and are contiguous with concrete floor 136 comprising a second level of the structure 120, a third level or floor 138, a fourth level or floor 140 and a fifth level defined by floor/ceiling 142 and closed by a ceiling 144. Interior spaces 146, 148, 150, 154 and 156 are formed by construction of reinforced concrete box or tunnel structures similar to the construction of the building 20. As previously mentioned the vertical sidewalls 133, 135, 137 and so on may be constructed of masonry block or the like. The structure 120 is also built, essentially, on the side of hill 26 which may be contoured to have a slope 28, 28*a* which does not require a reinforcement or retaining wall, depending on soil type and regulatory requirements.

In the embodiment shown in FIGS. 9 and 10, a first dwelling unit 122 is characterized by a vehicle garage or parking area occupying the space 146 and a stairway 141 leading to the second level defining a living space 148. Exterior and garage entries are arranged the same as for dwelling unit 22. A stairway 139 interconnects the level defined by the floors 136 and 138 and interior space 150 as part of dwelling unit 122.

A second dwelling unit 124 is vertically stacked above dwelling unit 122 and includes a vehicle garage or parking space 152 which is at an elevation two levels above parking space or garage 146 and essentially at the same level as the floor 138 but is spaced laterally somewhat from the vehicle garage or parking area 146. A vertical non-load bearing wall 153 is provided between garage space 152 and interior living space 150. Vehicle garage or parking area 152 is also defined by a deck 138*a* which may be a poured or prefabricated concrete slab which is supported by floor 138 and by one or more piers 83, for example, as shown. Load sharing of the weight of a vehicle 39 parked on the deck 138*a* between hill 26, pier 83 and floor 138 may be sufficient to avoid providing structure 120 with a vertical shear wall between floors 136 and 138.

Non-load bearing endwalls for dwelling unit 122 may be provided at the level of floor 134 and are designated by the numerals 163 and 172. Wall 163 may include a suitable upward acting garage door, not shown. In like manner, non-load bearing walls 181 and 182, 174, 176, 178, 179 and 180 may be provided at each end of the interior spaces 148, 150, 154 and 156, respectively, as shown in FIG. 9. A suitable garage door 166 may be provide for closing parking space 152 in a conventional manner and exterior and garage entries to stairway 141*a* provide access to dwelling unit 124 in the same manner as entries 66*b* and 66*c* provide access to dwelling unit 24.

Accordingly, the structure 120 enjoys all of the benefits of the structure 20 in addition to adding more living space within interior space 150 for dwelling unit 122, which comprises two living levels, while dwelling unit 124 also has two living levels defined by the interior spaces 154 and 156. The lengthwise span of floor 140 and split level portion 140*a* is greater than the combination floor 40, 40*a* for structure 20, thus providing more living space for dwelling unit 124.

Figure 11:
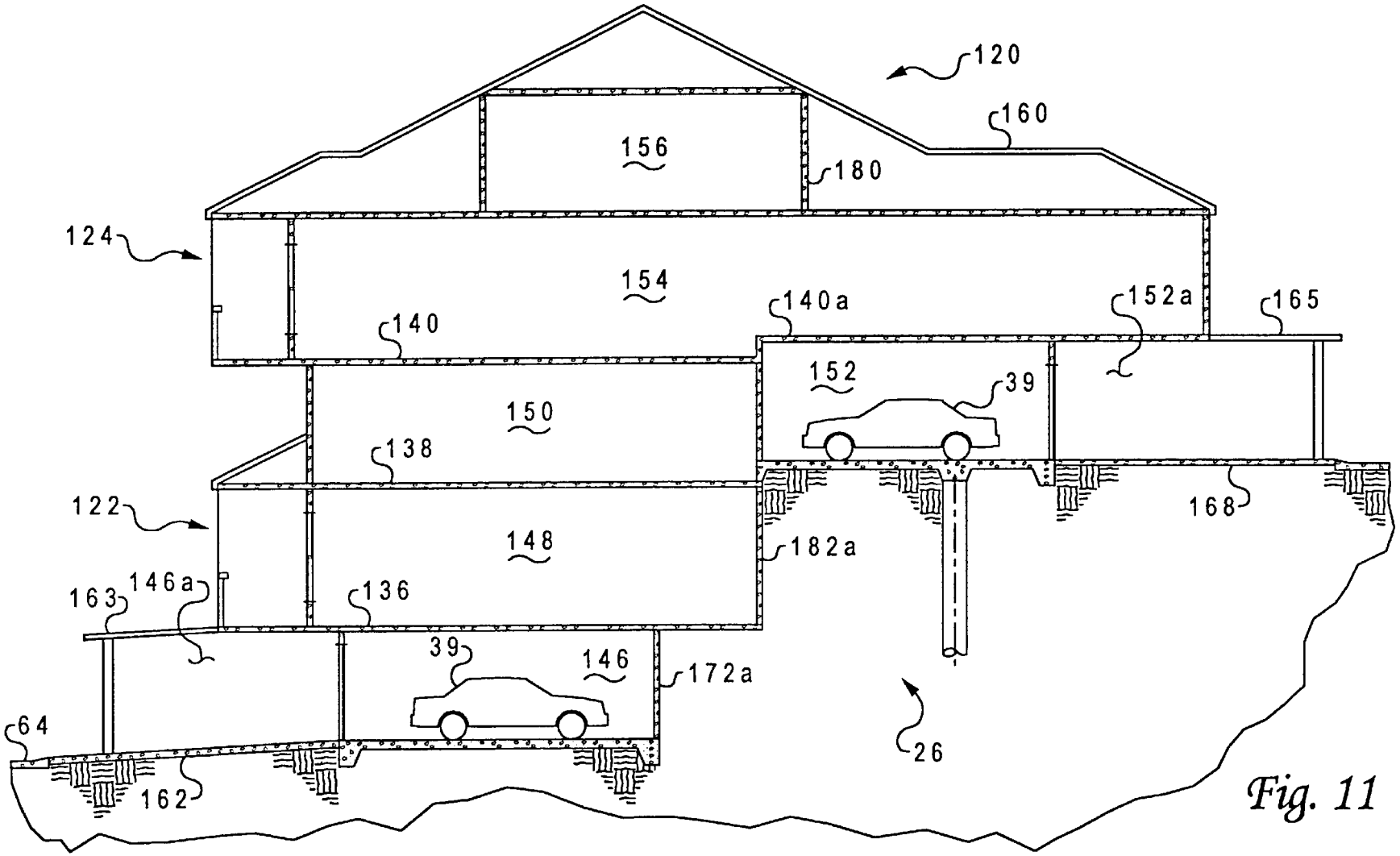
FIG. 11 is a section view similar to FIG. 9 showing the structure of FIG. 9 modified to be built into the side of a hill.

Referring now to FIG. 11, structure 120 may be modified to be built into the side of hill 26 in essentially the same manner as done with structure 20, as shown in FIG. 3. In this regard walls 172 and 182 are modified to be load-bearing reinforced concrete walls, for example, and are designated by the numerals 172*a* and 182*a*, respectively. In this way structure 120 may, for particularly steep hillsides, be constructed in a way to conserve space of the available land in the hillside and to minimize erosion or soil movement due to unstable soil conditions. The structure 120 shown in FIG. 11 is otherwise substantially unmodified. The walls 172*a* and 182*a* may, as with the structure 20, be formed of reinforced concrete which is poured at essentially the same time as the walls 133, 135, 137 and the floors 134, 136 and 138 are constructed. The dwelling unit floor plans for the dwelling units 122 and 124 may be similar in some respects to the floor plans illustrated in FIGS. 4 through 8. A conventional truss-type pitched roof 160 may be erected over the dwelling unit 124 in a manner similar to which the structure 20 is constructed.

Referring further to FIG. 11, the structure 120 may also be modified by the addition of a parking space 146*a* for dwelling unit 122 and a parking space 152*a* for dwelling unit 124. Vehicle parking space 146*a* is defined by driveway 162 and a roof 163 while parking space 152*a* is defined by driveway 168 and a roof 165. Interior spaces 146 and 152 may remain as vehicle parking spaces or may be converted to interior living spaces. Such an arrangement may, of course, be repeated for each dwelling unit in the structure 120.

Figure 12:
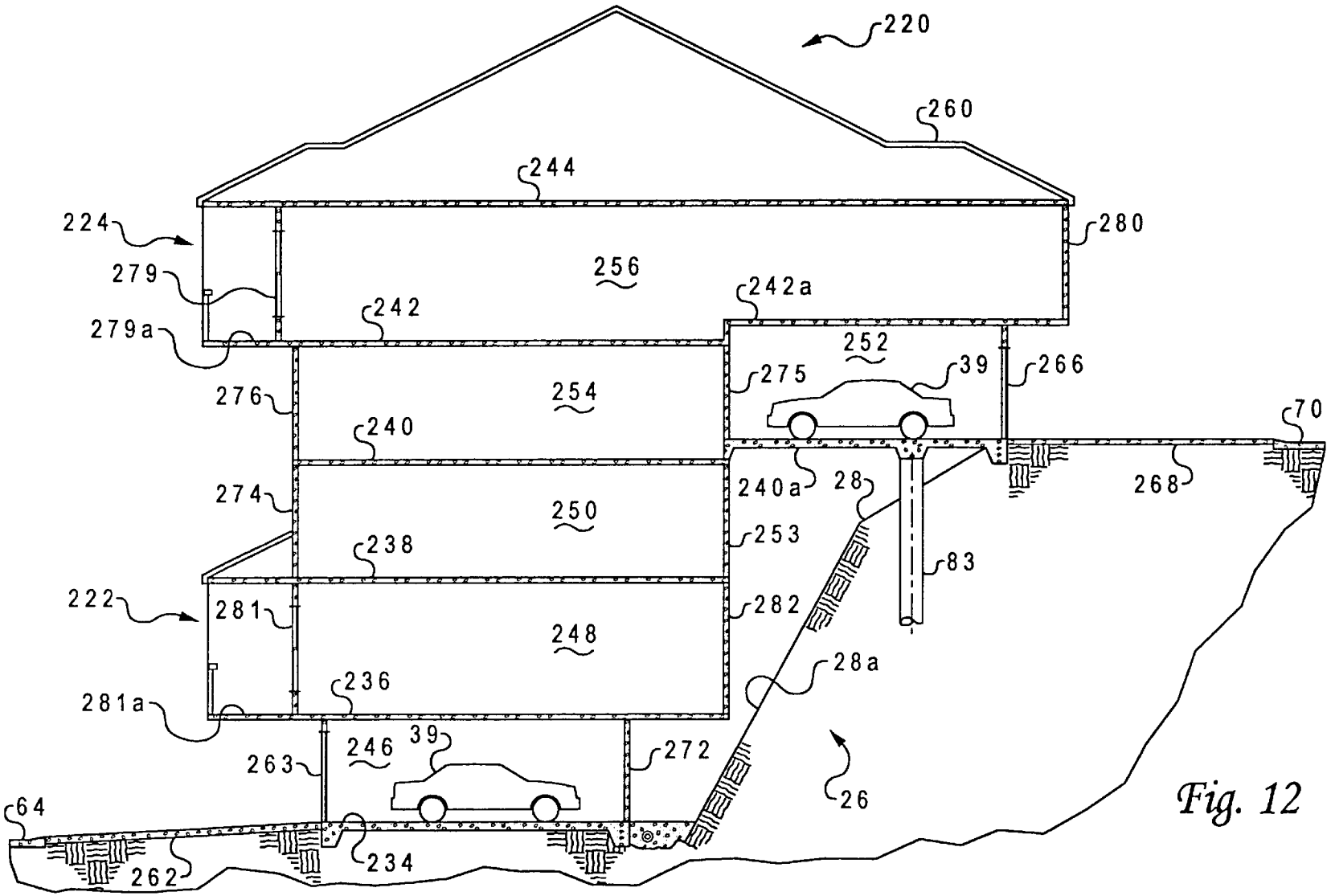
FIG. 12 is a vertical longitudinal section view of a second alternate embodiment of a hillside, multistory, multiple dwelling unit structure in accordance with the invention.

Referring now to FIG. 12, another embodiment of a hillside, multistory, multiple dwelling unit building structure is illustrated and generally designated by the numeral 220. The multiple dwelling unit structure 220 is also built as a hillside structure adjacent hill 26 which has been modified to have a dual slope 28, 28*a*, as shown in FIG. 12, and whereby a structure having essentially the same "tunnel" type construction is provided including a first level or floor 234 formed of a poured concrete slab or the like with a driveway 262 leading from roadway 64 to a garage or a parking space 246 having opposed, non-load bearing endwalls 263 and 272. Endwall 263 may, as with the other embodiments described herein, provide a vehicle entry opening which may be closed by a suitable garage door, not shown. Structure 220 includes a second level defined by a floor 236, a third level defined by a floor 238, a fourth level defined by a floor 240, and a fifth level defined by a floor 242, 242*a*. A ceiling 244 is disposed above floor 242, 242*a* and below a pitched roof 260, as shown. A second, opposed, vertically stacked garage or vehicle parking space is provided at the level substantially corresponding to the level of floor 240 and is formed, in part, by a ramped 240*a* supported, in part, by one or more piers 83 and in part by floor 240, as shown. Ramp 240*a* is contiguous with a driveway 268 between the ramp and roadway 70.

Vertically stacked dwelling units 222 and 224 are provided wherein dwelling unit 222 includes the garage or vehicle parking space 246, an interior living space 248 between floors 236 and 238 and an interior living space 250 between floors 238 and 240. Dwelling unit 224 includes a living space 254 between floors 240 and 242 and an interior living space 256 between floor 242 and ceiling 244. Non-load bearing endwalls 281, 282, 274 and 253 enclose the living spaces of dwelling 222. Endwalls 275 and 276 enclose space 254 and wall 275 together with a door or ported endwall 266, limit the garage or parking space 252. Endwalls 279 and 280 define opposite ends of the living space 256. Stairways, not shown, are provided between levels 234 and 236 and between levels 236 and 238 and a stairway between levels 240 and 242, also not shown, may be arranged similar to the stairways for the structure 120, for example.

The structure 220 has the same number of levels as the structure 120 with the advantage that the dwelling unit 224 has a living space 254 at the same level as the garage or parking space 252. For example, a door, not shown, in wall 275 may provide movement between the spaces 252 and 254. The endwalls 281, 274, 276 and 279 may be provided with suitable windows and/or doorways opening onto balconies 281*a* and 279*a*, for example. The structure 220, as mentioned previously, may be constructed in substantially the same manner as the structures 20 and 120, having vertical sidewalls interconnecting the floors 234, 236, 238, 240, and 242 and the ceiling 244 and formed as a substantially integral structure of reinforced concrete or of suitable stacked masonry blocks and the like.

Figure 13:
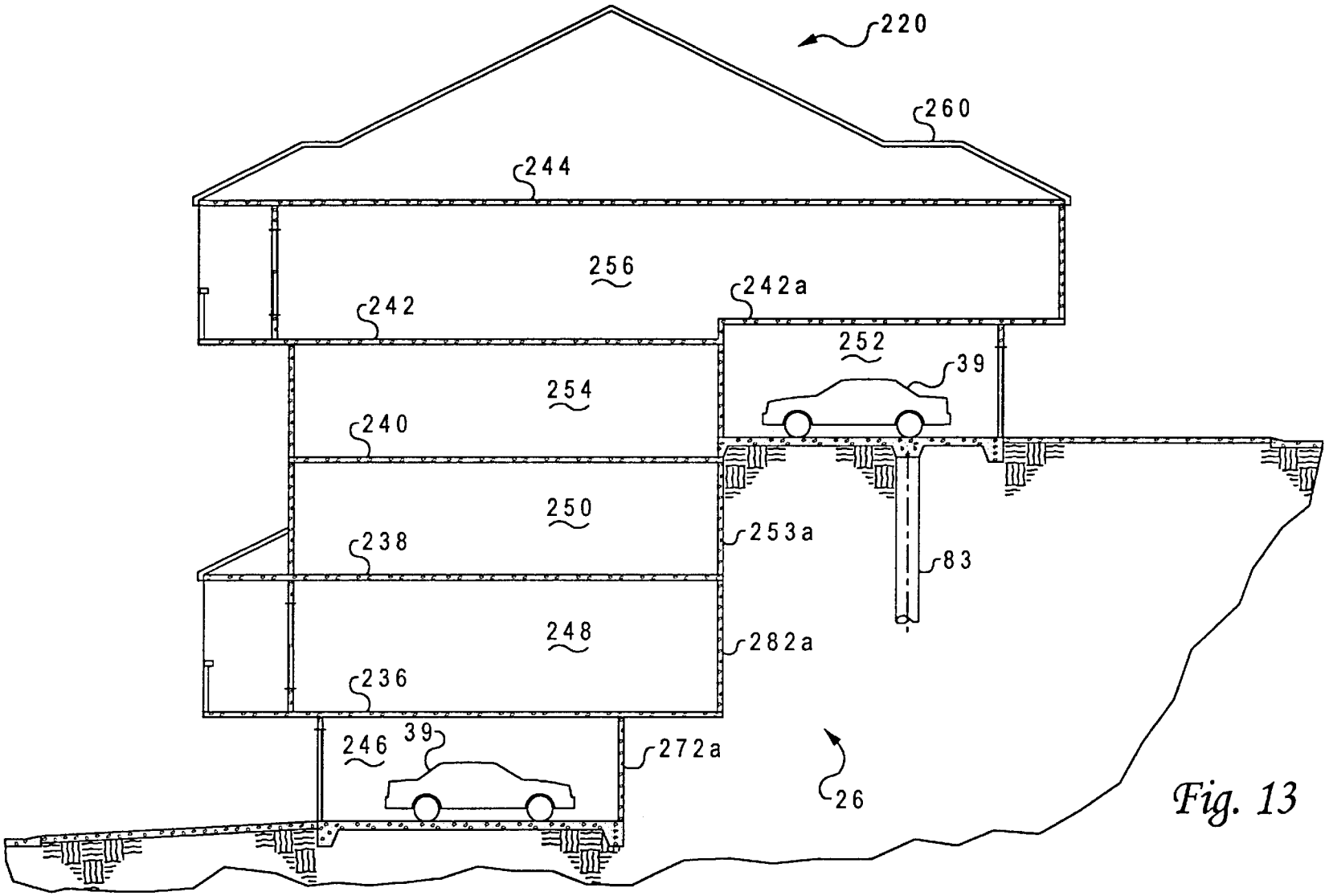
FIG. 13 is a view similar to FIG. 12 showing the structure of FIG. 12 modified and built into the side of a hill.

Referring briefly to FIG. 13, the structure 220 may be modified to have reinforced load bearing walls 253*a*, 282*a*, and 272*a* wherein the structure 220 may be built into the side of hill 26, in a manner generally as illustrated, and corresponding to the alternate disposition of the structures 20 and 120. Walls 253*a*, 282*a* and 272*a* may be formed of reinforced concrete or masonry block and, if formed of concrete, formed integral with the contiguous floors and sidewalls. The living spaces for the structure 220 may, as with the structures 20 and 120, be configured to be of a width of one room at each level of each dwelling unit. FIGS. 2, 4 through 8 and 10 illustrate the general design arrangement of the dwelling units associated with the embodiments described and shown in those drawing figures. The arrangement of the dwelling units 222 and 224 may be similar in that respect.

Figure 14:
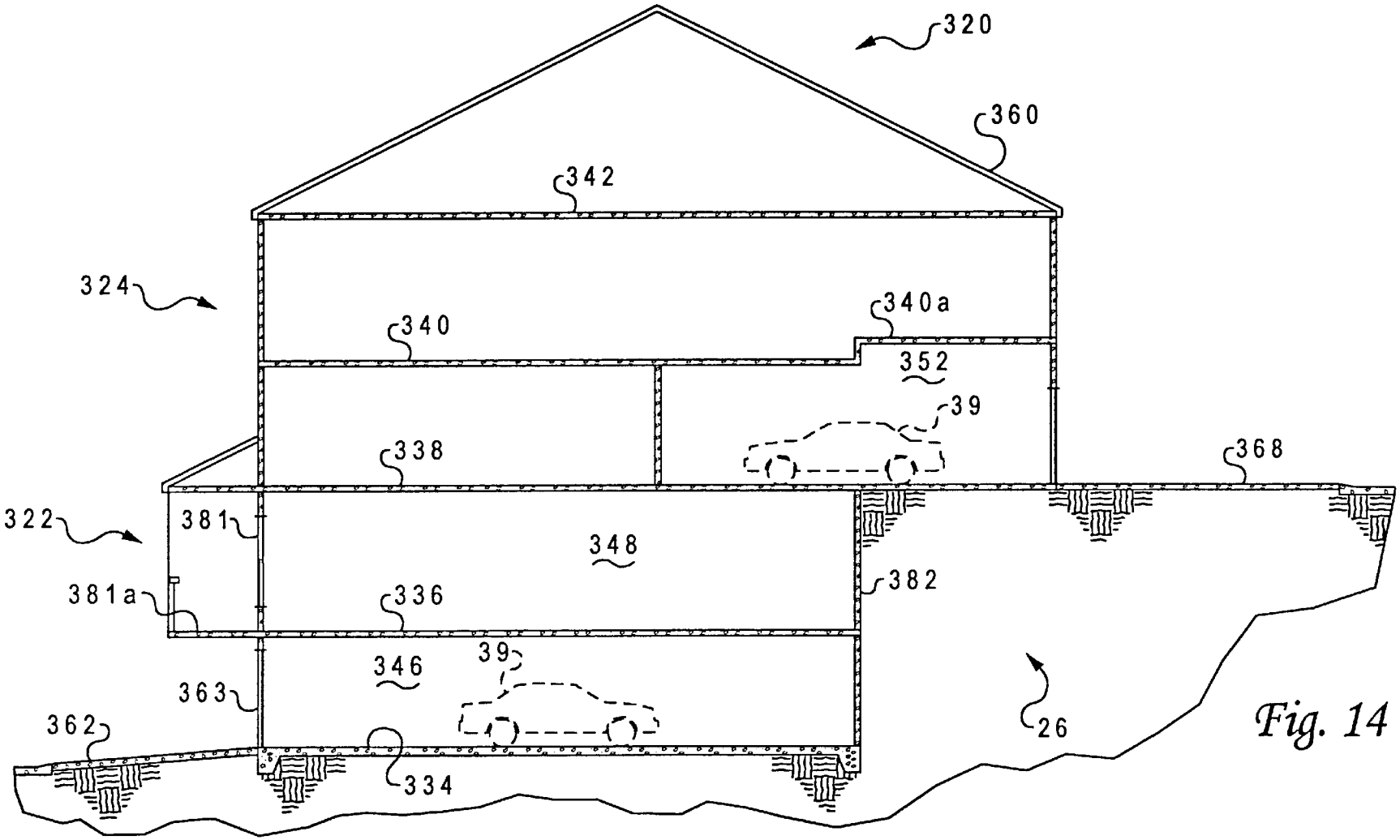
FIG. 14 is a vertical longitudinal section view of a third alternate embodiment of a hillside, multistory, multiple dwelling unit structure.

Referring now to FIG. 14, the hill 26 may also be the site of erection of a hillside, multistory, multiple dwelling unit structure in accordance with another embodiment of the invention and generally designated by the numeral 320. The structure 320 includes a first level defined by a floor 334 comprising a poured concrete slab or the like, a second level defined by a floor 336, a third level defined by a floor 338, a fourth level defined by a floor 340, 340*a* and a ceiling 342. A conventional truss-type pitched roof 360 may be disposed over the ceiling 342. Floors 334, 336, 338, 340 and ceiling 342 may be constructed in the manner similar the embodiments illustrated in FIGS. 1 through 13.

The structure 320 may include a first dwelling unit 322 occupying the first two levels of the structure and a second dwelling unit 324 occupying the third and fourth levels of the structure. The first level defined by the floor 334 may include a vehicle garage or parking space 346 for parking two vehicles 39 side by side and the third level, defined by a floor 338 may include a vehicle garage or parking space 352 which is accessible from a side of the structure 320 opposite the side at which the garage 346 is accessed, and may also be adapted for parking plural vehicles, side by side. Opposed driveways 362 and 368 are aligned with the garages or parking spaces 346 and 352, respectively.

Figure 15:
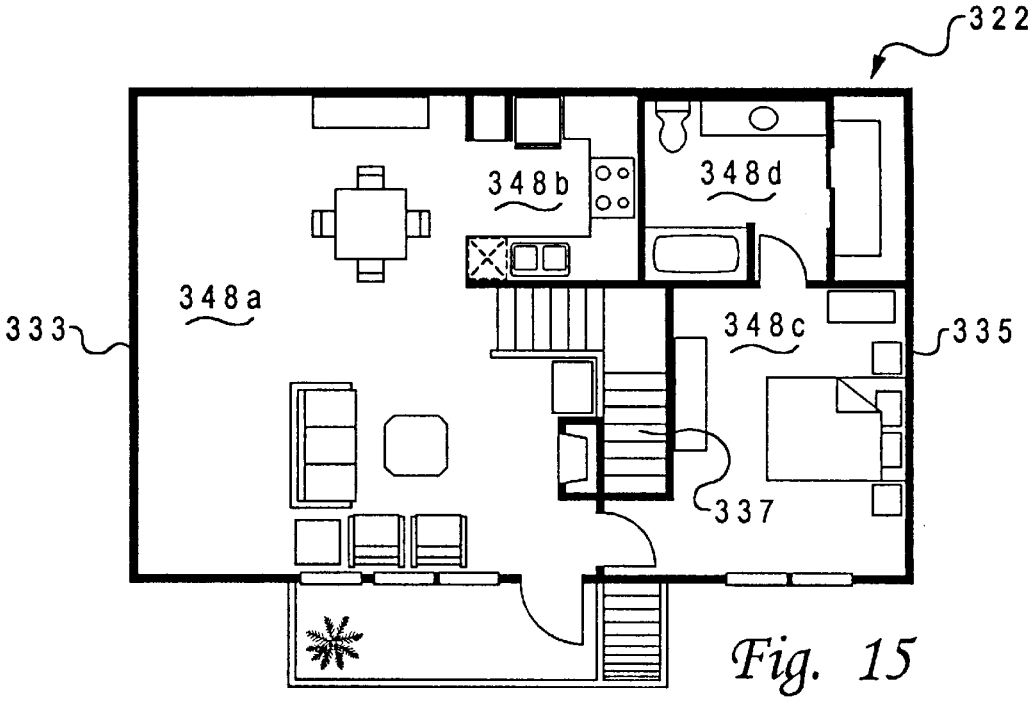
FIG. 15 is a floor plan of the second level of the lower dwelling unit of the embodiment shown in FIG. 14.
Figure 16:
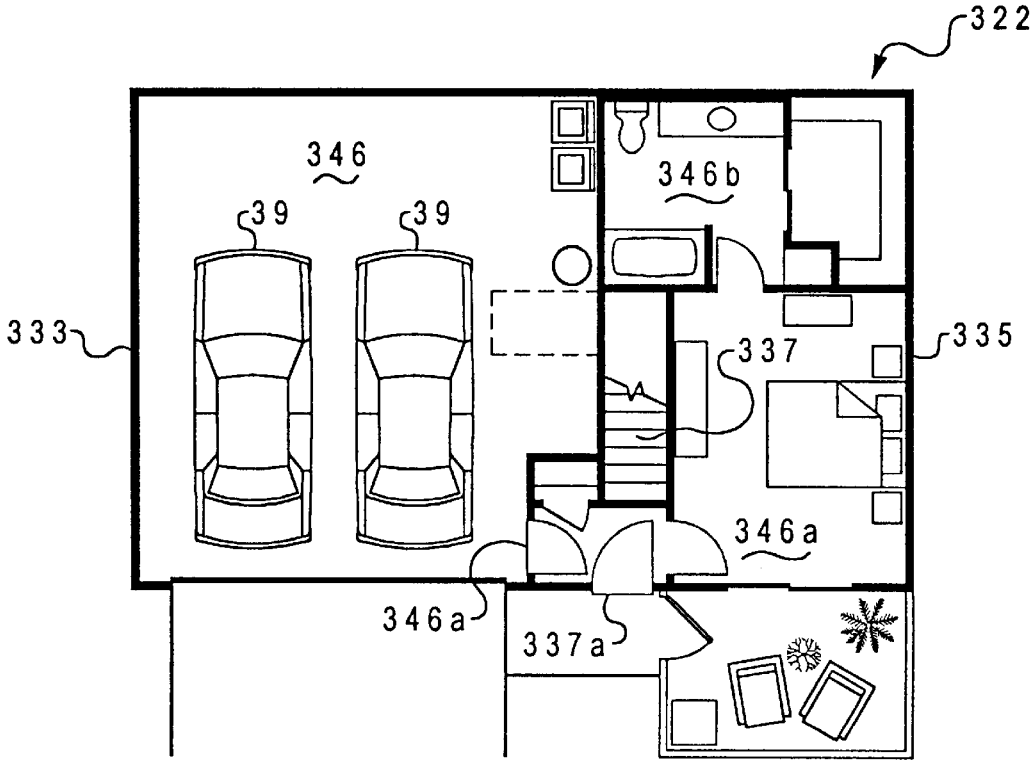
FIG. 16 is a floor plan of the lower level of the lower dwelling unit of the structure shown in FIG. 14.

The structure 320 may be arranged in such a way that the width of each dwelling unit 322 and 324 is more than one room. Referring to FIGS. 15 and 16, for example, the floor plan of dwelling unit 322 is illustrated wherein at the first level, defined by floor 334 and ceiling or floor 336, the garage or parking space 346 is adjacent to a living space including a bedroom, for example, 346*a* and adjacent bath 346*b*. The upper level of lower dwelling unit 322 includes an interior space 348 which may be divided into a living area 348*a*, a kitchen 348*b* a be d room 348*c* and a second bathroom 348*d*. Stairway 337 interconnects the two levels of dwelling unit 322 and is accessible through entrances 346*a* or 337*a*. Opposed sidewalls 333 and 335 of the structure 320 may be formed integral with the floors 334, 336 and 338 as well as the floor 340 and the ceiling 342. A load bearing endwall 382 extends between floors 338 and 334 and may be formed integral with floors 334, 336 and 338 at the time that these levels are constructed. Non-load bearing endwall 363, which may include a garage door, and 381 which may include windows opening onto a balcony 381*a*, enclose the interior spaces 346 and 348.

The floor plan for the dwelling unit 324 may be similar in some respects to that just described and shown in FIGS. 15 and 16 or other floor plans may be utilized to provide a suitable dwelling unit. The structure 320 is exemplary in that it indicates that dwelling units having a width more than a conventional room width may be constructed including the features of the present invention wherein a structure having opposed, vertically stacked vehicle garages or parking spaces together with multistory, multiple dwelling units may be advantageously constructed in a hillside setting.

Figure 17:
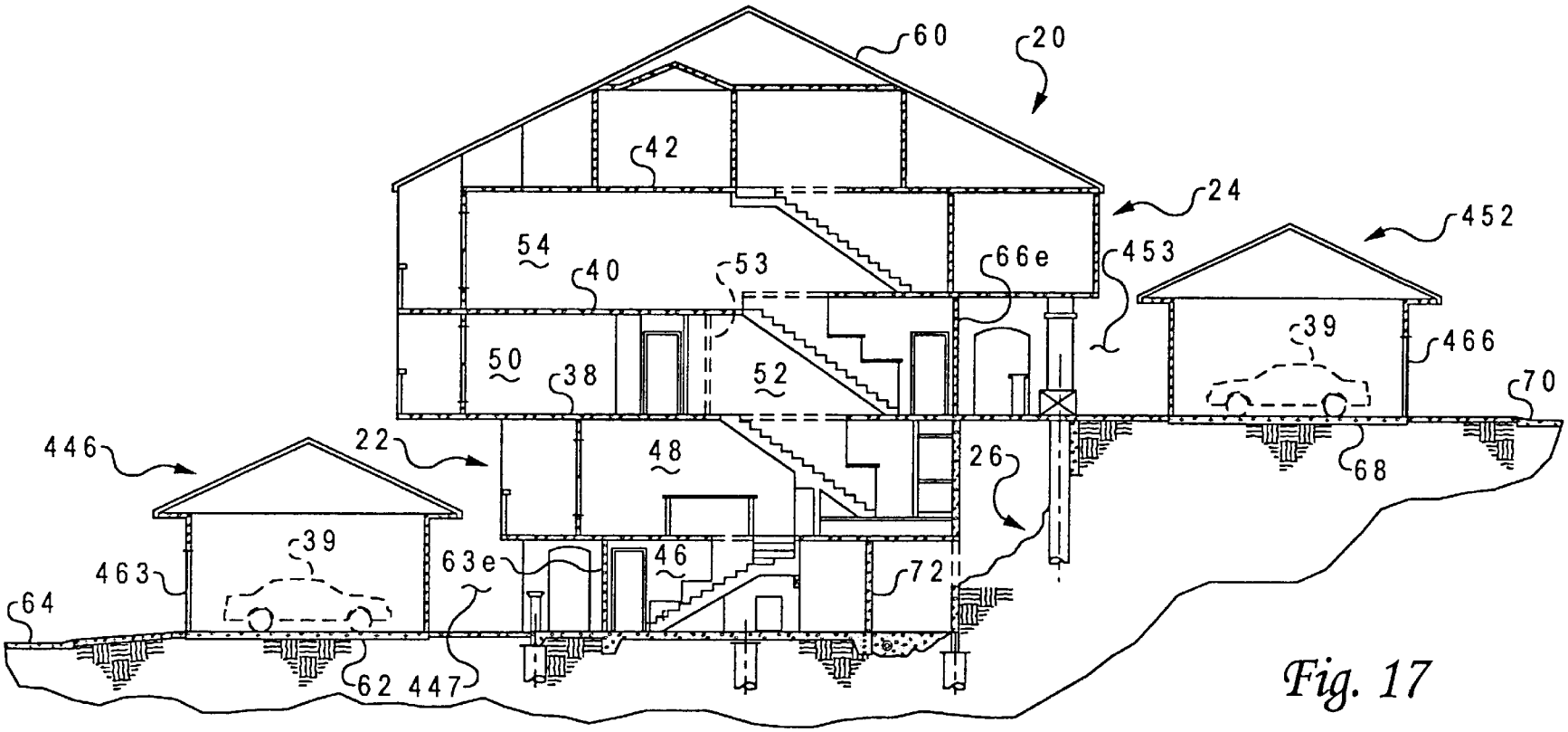
FIG. 17 is a vertical longitudinal section view of a fourth alternate embodiment of a hillside, multistory, multiple dwelling unit structure.

Referring now to FIG. 17, if the roadways 64 and 70 are set far enough apart with respect to each other and hill 26, the building or structure 20, as shown in FIG. 17, may be modified in such a way that the interior spaces 46 and 52 of the respective dwelling units 22 and 24 may be converted to interior living space and vehicle parking spaces provided on driveways 62 and 68 or, alternatively, respective carports or garages 446 and 452 may be constructed detached from the structure 20 and disposed at the respective driveways 62 and 68, as illustrated. Respective courtyard areas 447 and 453 may be provided between the respective garages 446, 452 and their associated dwelling units 22 and 24, respectively. Garage entrances 63 and 66 may be replaced by conventional non-load bearing walls 63*e* and 66*e* while exterior entries to the respective living units 22 and 24 may remain unchanged and are as described for the embodiment of building 20 shown and described in conjunction with FIGS. 1 through 8. Accordingly, the embodiment illustrated in FIG. 17 enjoys all of the advantages of the embodiment illustrated and described in conjunction with FIGS. 1 through 8 with the exception that the vehicle parking spaces are directly adjacent to respective living units of the building as just described. Garages 446 and 442 have respective vehicle entries 463 and 466 facing the roadways 64 and 70, respectively.

Moreover, although a preferred method of constructing the structures 20, 120, 220 and 320 has been described herein, those skilled in the art will appreciate that other construction methods may be utilized while enjoying the advantages of the present invention. All endwalls described above may be load bearing walls, for example. Still further, although preferred arrangements of the stairways for each of the structures 20, 120, 220 and 320 are disclosed hereinabove, other stairway configurations extending between the various levels of the dwelling units may be utilized.

Although preferred embodiments of the invention have been described in detail, those skilled in the art will also recognize that various substitutions and modifications may be made to the structures described herein without departing from the scope and spirit of the invention as recited in the appended claims.

What is claimed is:

1. A hillside, multistory building having at least two, vertically stacked dwelling units therein, one of said dwelling units includes a vehicle parking space for at least one automotive vehicle at a first level and including a vehicle entry on a first side of building opening to a first roadway, said one dwelling unit includes an enclosed living space separate from said vehicle parking space for said one dwelling unit and at least one level directly above said first level, another of said dwelling units being vertically stacked above said one dwelling unit and including a vehicle parking space for at least one automotive vehicle and an enclosed living space and having a vehicle entry opening to a second roadway on an opposite side of said building from said first mentioned roadway and being disposed at an elevation at least one level above said first level; and dwelling unit entries for each of said dwelling units, respectively, on opposite sides of said building.

2. The building set forth in claim 1 wherein:

said vehicle parking space for said one dwelling unit is disposed within said building at said first level.

3. The building set forth in claim 1 wherein:

said vehicle parking space of said other dwelling unit is disposed within said building.

4. The building set forth in claim 1 wherein:

said one dwelling unit includes said dwelling unit entry at said first level.

5. The building set forth in claim 4 wherein:

said other dwelling unit includes said dwelling unit entry at another level above said first level, said dwelling unit entries being vertically spaced on said opposite sides of said building.

6. The building set forth in claim 1 wherein:

said one dwelling unit includes said enclosed living space at a second level directly above said first level and defined by a floor of said second level and an enclosed living space at a third level disposed above said second level and defined by a floor above said second level.

7. The building set forth in claim 6 wherein:

said first, second and third levels of said one dwelling unit are interconnected by stairways, respectively, and said stairways are disposed one above the other at respective ones of said levels of said one dwelling unit.

8. The building set forth in claim 7 wherein:

said dwelling unit entry to said one dwelling unit opens to said stairway between said first level and said second level of said one dwelling unit.

9. The building set forth in claim 6 wherein:

said vehicle parking space of said other dwelling unit is at the same level as said third level of said one dwelling unit and is defined in part by said floor defining said third level.

10. The building set forth in claim 6 wherein:

said other dwelling unit includes said enclosed living space at a fourth level defined by a floor of said fourth level.

11. The building set forth in claim 10 wherein:

said other dwelling unit includes an enclosed living space at a fifth level defined by a floor at said fifth level and disposed above said floors defining said first level through said fourth level.

12. The building set forth in claim 11 wherein:

said other dwelling unit includes stairways interconnecting said third level with said fourth level and said fourth level with said fifth level, respectively, said stairways being aligned with each other on one side of said building.

13. The building set forth in claim 6 wherein:

each of said levels of said building is defined by one of said floors and substantially vertical sidewalls defining said living spaces.

14. The building set forth in claim 13 wherein:

said floors and said sidewalls are integral with each other and are formed of reinforced concrete.

15. The building set forth in claim 13 wherein:

said living spaces and said vehicle parking spaces are further defined by transverse endwalls of said dwelling units, respectively.

16. The building set forth in claim 14 wherein:

said first level and said second level of said one dwelling unit include endwalls formed of reinforced material and forming retaining walls for earth forming a hill at which said building is disposed.

17. The building set forth in claim 6 wherein:

each of said dwelling units is formed by a generally elongated shell structure at each level and formed of reinforced concrete, and said living spaces and parking spaces of said dwelling units are closed by non-load bearing endwalls defining, at least in part, said living spaces and said vehicle parking spaces, respectively.

18. The building set forth in claim 1 wherein:

said building is adapted to be disposed adjacent a hill spaced from said first level and a second level of said building.

19. The building set forth in claim 1 wherein:

said building is adapted to be disposed adjacent a hill contiguous with a wall of said first level and said second level of said building.

20. The building set forth in claim 19 wherein: said building having a third level having an end wall being adapted to be contiguous with the hill.

21. The building set forth in claim 1 wherein:

said first level of said one dwelling unit comprises a vehicle garage, a second level of said one dwelling unit includes said living space including a kitchen, and a third level of said one dwelling unit comprises a living space including a bedroom.

22. The building set forth in claim 21 wherein:

said third level of said building includes a garage of said other dwelling unit, a fourth level of said building includes said living space of said other dwelling unit, including a kitchen, and a fifth level of said building includes a bedroom of said other dwelling unit.

23. The building set forth in claim 1 wherein:

said vehicle parking space of said other dwelling unit includes a deck to be supported directly on a hill adjacent said building.

24. The building set forth in claim 23 wherein:

said deck is supported at one end by pier means adapted to extend into said hill and at another end by a wall of said building.

25. The building set forth in claim 1 wherein:

said vehicle parking space for said one dwelling unit comprises a detached garage disposed directly adjacent to said one dwelling unit and between said one dwelling unit and said first roadway.

26. The building set forth in claim 1 wherein:

said vehicle parking space for said other dwelling unit comprises a detached garage disposed directly adjacent to said other dwelling unit and between said other dwelling unit and said second roadway.

27. A hillside, multistory building having at least two, vertically stacked dwelling units therein, one of said dwelling units having a first level including a floor supported at ground level and defining a first vehicle garage, an entry to said first garage opening on one side of the building and having a driveway adapted to extend between said first garage and a roadway, an upper level of said one dwelling unit including a floor, vertically spaced from said floor at said first level of said one dwelling unit and defining a living space of said one dwelling unit, and another of said dwelling units vertically stacked above said one dwelling unit and having a second vehicle garage, said second garage having an entry adjacent to a driveway on a side of said building opposite the driveway of said first garage and adapted to be connected to a roadway on a hill adjacent said building and at an elevation above said roadway connected to said driveway for said first garage.

28. The building set forth in claim 27 wherein:

said upper level of said one dwelling unit is a second level including said floor between a first level and a floor defining said second garage, said second level including said living space for said one dwelling unit.

29. The building set forth in claim 28 wherein:

said one dwelling unit includes a living space at a third level disposed above said second level and defined by said floor for said second garage, said other dwelling unit includes a living space at a fourth level defined by a floor of said fourth level and vertically spaced from said floor of said third level.

30. The building set forth in claim 29 wherein:

said first, second and third levels of said one dwelling unit are interconnected by stairways, respectively.

31. The building set forth in claim 29 wherein:

each of said dwelling units is formed by a generally elongated shell structure at each level and formed of reinforced concrete, and said living spaces and garages of said dwelling units are closed by endwalls defining, at least in part, said living spaces and said garages, respectively.

32. The building set forth in claim 31 wherein:

at least one endwall, defining an endwall of said one dwelling unit is adapted to be contiguous with said hill and forms a retaining wall for said hill.

33. A hillside, multistory, multiple dwelling unit building comprising at least two, vertically stacked dwelling units therein, said building comprising plural vertically spaced floors, sidewalls and endwalls defining living spaces of said dwelling units, respectively, said floors and said sidewalls being formed of reinforced concrete or the like, a first dwelling unit in said building having a garage defined by a first floor of said building at a first level which is a ground level, an entry to said garage opening on one side of the building driveway means connecting a first roadway on one side of said building with said garage of said first dwelling unit, a second dwelling unit vertically stacked above said first dwelling unit and including a garage defined by a second floor of said building vertically spaced from said first floor defining said garage of said first dwelling unit, an entry to said garage of said second dwelling unit opening on a side of said building opposite the side of said entry to said garage of said first dwelling unit and adjacent a driveway interconnecting said garage of said second dwelling unit with a second roadway at an elevation above said first roadway, said garages being vertically stacked, one above the other in said building, and said second floor defining said garage of said second dwelling unit also second dwelling unit also defines a floor of a living space of said first dwelling unit.

* * * * *